US011492816B2

(12) United States Patent
Eckhardt

(10) Patent No.: US 11,492,816 B2
(45) Date of Patent: Nov. 8, 2022

(54) POOL STEP STRUCTURE WITH INTEGRATED PLUMBING

(71) Applicant: Nicholas W. Eckhardt, Land O' Lakes, FL (US)

(72) Inventor: Nicholas W. Eckhardt, Land O' Lakes, FL (US)

( * ) Notice: Subject to any disclaimer, the term of this patent is extended or adjusted under 35 U.S.C. 154(b) by 0 days.

(21) Appl. No.: 17/164,924

(22) Filed: Feb. 2, 2021

(65) Prior Publication Data

US 2022/0243488 A1 Aug. 4, 2022

(51) Int. Cl.
*E04H 4/14* (2006.01)
*E04H 4/12* (2006.01)

(52) U.S. Cl.
CPC ..... *E04H 4/144* (2013.01); *E04H 4/1218* (2013.01)

(58) Field of Classification Search
CPC ..... E04H 4/144; E04H 4/1209; E04H 4/1218
USPC ..... 4/506
See application file for complete search history.

(56) References Cited

U.S. PATENT DOCUMENTS 3,036,712 A * 5/1962 Barbara ..... E04H 4/144 D25/41.1
3,090,465 A 5/1963 Smith
4,527,297 A * 7/1985 Pettit ..... E04H 4/1209 182/86
4,599,753 A * 7/1986 Goodman ..... A61H 33/6026 4/488
5,715,907 A * 2/1998 Andret ..... E04H 4/144 182/115
6,102,156 A * 8/2000 Lipniarski ..... E06C 7/081 182/115
9,072,922 B2 7/2015 Cordani
9,388,594 B2 7/2016 Erlich

* cited by examiner

*Primary Examiner* — Huyen D Le
(74) *Attorney, Agent, or Firm* — Binita J. Singh; Bold IP, PLLC

(57) ABSTRACT

One or more embodiments of a device for providing a structure for a person to enter and exit a pool and support plumbing for the pool are disclosed. The structure includes a step structure, suction plumbing, and return plumbing. The step structure includes steps and a support structure configured to support the steps. The suction plumbing is fixed to the step structure and includes a first high point. The suction plumbing also includes a suction outlet below the first highpoint. The suction plumbing is arranged to pull water via the suction outlet and the first high point. The return plumbing is separate from the suction plumbing and is fixed to the step structure. The return plumbing includes a second high point and a return outlet. The return plumbing is arranged to output water via the second high point and the return outlet.

20 Claims, 15 Drawing Sheets

POOL STEP STRUCTURE WITH INTEGRATED PLUMBING

FIELD OF THE DISCLOSURE

The present invention relates stair structures allowing people to enter into and exit out of pools. The present invention is also related to recirculatory plumbing for pools.

BACKGROUND

Pools often include a set of steps, in the form of a staircase or ladder, which allow users of the pool to enter into and exit out of the pool. For pools that are below ground level, often a staircase is built into the walls of the pool. Ladders are also used especially for deep pools. The pool also includes plumbing for recirculating water. The plumbing often comes in the form of pipes connected through holes in the side or bottom structure of the pool. The plumbing is often buried underground and almost completely inaccessible for maintenance purposes. It is quite common for the plumbing to leak or the connection between the plumbing and the pool structure to leak. Fixing a leak in the plumbing or in the connection between the plumbing and the pool structure can be very laborious and expensive.

For pools that are above ground level, step structures are often used that go from ground level over the side of the pool and into the pool with a generally upside down 'v' shape. Many above ground pools also include plumbing for recirculating water. Many above ground pools include holes in the side of the pool structure for the plumbing to interface with the interior of the pool. These holes in the side of the pool structure and connections to the plumbing are a known weak point in the side structure of above ground pools and often have leaks or even catastrophic breaks that cause the pool to be unusable. Significant efforts have been made to improve and strengthen the connections between the plumbing and the pool structure. However, the problems of leaking and breaks around the connections between the plumbing and the pool structure persist.

Both above ground and below ground pools have problems with pool plumbing that significantly increase the cost of manufacture and upkeep of the pool while providing unsatisfactory results. All efforts to work with the current structures to mitigate the problems have yet to provide a satisfactory solution.

SUMMARY

One or more embodiments are provided below for a device for providing a structure for a person to enter and exit a pool and support plumbing for the pool. The structure may include a step structure, suction plumbing, and return plumbing. The step structure may include steps and a support structure configured to support the steps. The suction plumbing may be fixed to the step structure and include a first high point. The suction plumbing may also include a suction outlet below the first highpoint. The suction plumbing may be arranged to drain water via the suction outlet and the first high point. The return plumbing may be separate from the suction plumbing and be fixed to the step structure. The return plumbing may include a second high point and a return inlet. The return plumbing may be arranged to output water via the second high point and the return inlet.

The device may provide significant advantages over the devices known in the art. The step structure allows for people to enter or exit a pool while also providing support and protection for plumbing entering into the pool. The plumbing is much more readily accessible for repair than is possible in some prior art. The plumbing may pass over the side of the pool and not pass through the side structure of the pool so it may not lead to the problems associated with connecting plumbing through the side structure of the pool. The step structure may also provide the advantage of having the plumbing out of sight, improving the athletic appeal of the pool, and reducing the area encumbered by equipment for the pool.

Other advantageous features as well as other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
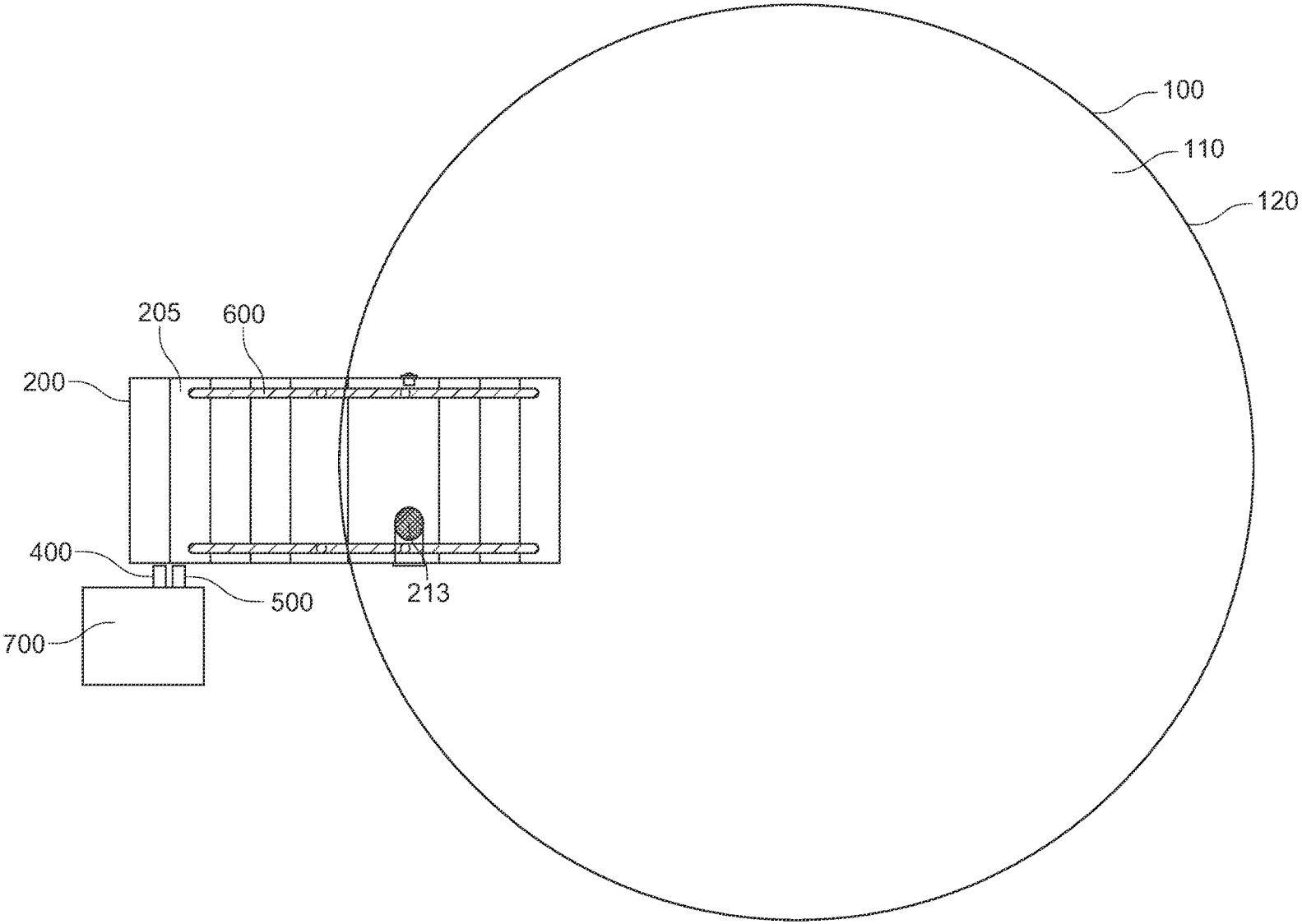
FIG. 1 is a top view of a pool with the step structure extending over the rim of the pool.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "coupled to" as used herein may mean a direct or indirect connection via one or more components.

Referring now to the drawings and the following written description of the present invention, it will be readily understood by those persons skilled in the art that the present invention is susceptible to broad utility and application. Many embodiments and adaptations of the present invention other than those herein described, as well as many variations, modifications, and equivalent arrangements will be apparent from or reasonably suggested by the present invention and the detailed description thereof, without departing from the substance or scope of the present invention. This disclosure is only illustrative and exemplary of the present invention and is made merely for purposes of providing a full and enabling disclosure of the invention.

FIG. 1 is a top view of a pool 100 with the step structure 200 extending over a rim 120 of the pool 100. The pool 100 may include a bowl 110. The bowl 110 may be a structure arranged to hold water in the pool. The pool 100 may have a rim 120 on a top edge of the bowl. The rim 120 may be a separate structure from the bowl 110 or may be the upper adle of the bowl 110. The rim 120 may have a circular shape. Other shapes, such as rectangular or oval may also be used. If the pool 100 is an above ground pool, the bowl 110 may have a uniform depth. If the pool 100 is below ground, the bowl 110 may vary in depth. The bowl 110 may include any durable material suitable for retaining water, such as sealed concrete, plastic, or other materials commonly used in pools. The rim 120 may include the materials of the bowl 110 and may further include materials such as metal or plastic pipes, which are commonly used for creating a supporting structure for the bowl of a pool. The rim 120 may also include bumpers or other material for the comfort and safety of users of the pool 100.

The step structure 200 may include steps 205, which allow a user to walk or climb into and out of the pool 100 over the rim 120 of the pool 100. The steps 205 include a durable material such as a plastic or other material suitable to be stepped on and support the weight of a human adult. The step 205 may be a stair or ladder type step. The steps 205 may include a coating or surface that gives sufficient friction to a wet foot of a user to mitigate the risk of slipping. One of the steps 205 may include a removable access lid 213 which will be discussed in greater detail below. The step structure 200 may include return plumbing 400 and suction plumbing 500 that are at least partially under the steps 205. The return plumbing 400 and suction plumbing 500 may connect to a water filtration system 700. The water filtration system 700 may pump water out of the pool 100 via the suction plumbing 500, filter water, and pump water into the pool 100 via the return plumbing 400. The water filtration system 700 may be any form of water filtration system which is used for filtering water, filling and emptying pools, and other similar tasks. The suction plumbing 500 may be connected as an input to the water filtration system 700 and the return plumbing 400 may be connected as an output to the water filtration system 700

The step structure 200 may also include handrails 600. The handrails 600 may extend over some or all of the steps 205 to assist users of the step structure 200 with entering and leaving the pool 100. The handrails 600 may be made of any durable material such as plastic, metal, etc.

Figure 2:
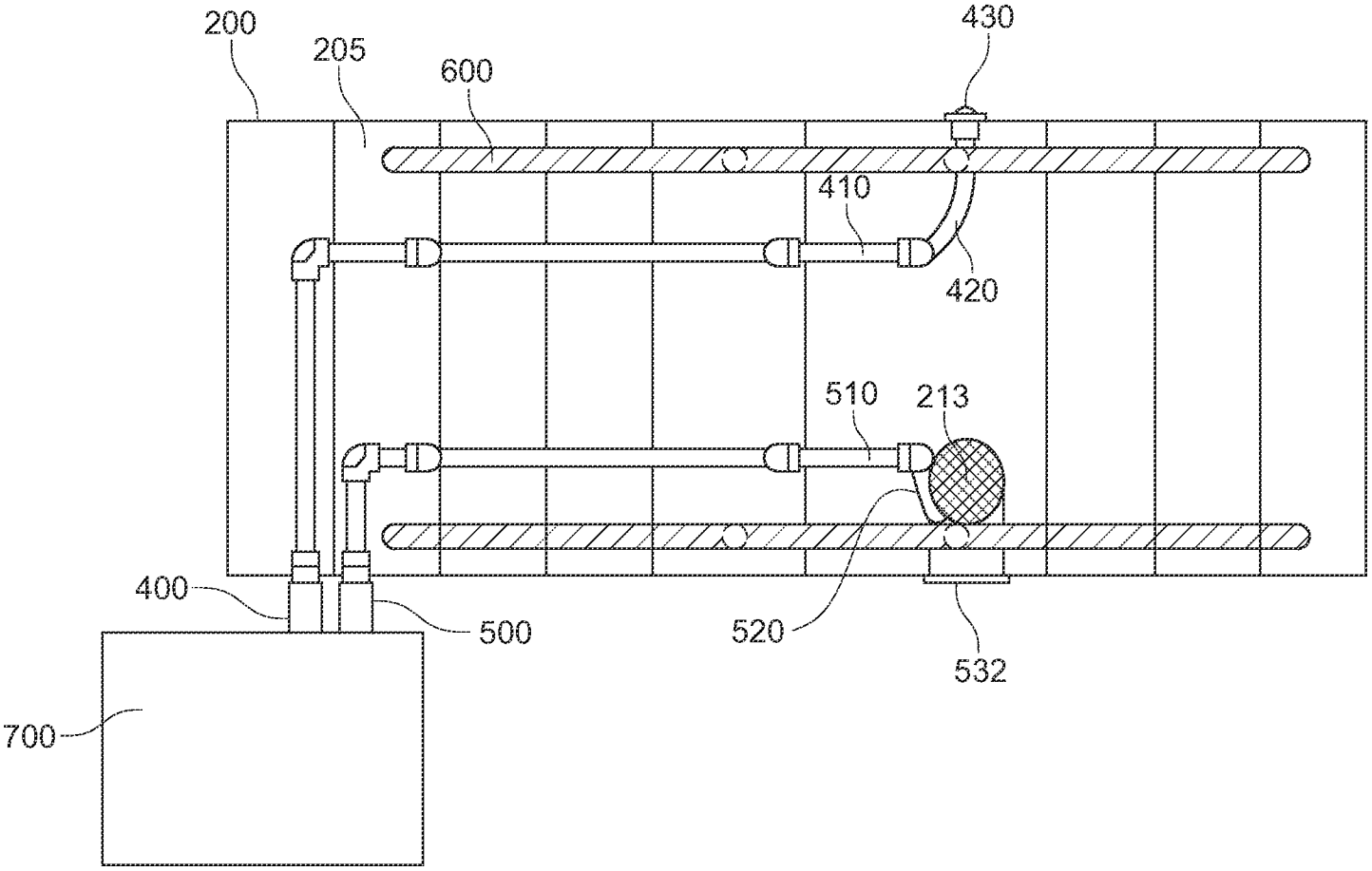
FIG. 2 shows an example top view of the step structure with the return plumbing and suction plumbing visible through the steps.

FIG. 2 shows an example top view of the step structure 200 with the return plumbing 400 and suction plumbing 500 visible through the steps 205. The return plumbing 400 and the suction plumbing 500 are below the steps 205 but shown through the stairs to show the relative positioning of the components from a top view.

The return plumbing 400 may extend from the water filtration system 700 under at least some of the steps 205, over the rim 120 (not shown in this figure) to an inlet 430 (this may be an example of a return inlet) in the pool 100 (not shown in this figure). The return plumbing 400 may include inflexible piping 410 and flexible piping 420. The inflexible piping 410 may include pipes made of materials less flexible than the materials of the flexible piping 420. For example, the flexible piping 420 may be a flexible plastic or silicone tubing which can be easily bent by hand. The inflexible piping 410 may include pipes of metal or inflexible plastic that is not easily bent by hand. It may be advantageous to use inflexible piping 410 in locations where movement of the return plumbing 400 is not desired because inflexible piping 410 may be more durable and less likely to kink than flexible piping 420.

The suction plumbing 500 may extend from the water filtration system 700 under at least some of the steps 205, over the rim 120 (not shown in this figure) to an outlet 532 (this may be an example of a skimmer or a suction outlet) in the pool 100 (not shown in this figure). The suction plumbing 500 may include inflexible piping 510 and flexible piping 520. The inflexible piping 510 may include pipes made of materials less flexible than the materials of the flexible piping 520. For example, the flexible piping 520 may be a flexible plastic or silicone tubing or other material which can be easily bent by hand. The inflexible piping 510 may include pipes of metal, inflexible plastic, or similar materials that are not easily bent by hand. It may be advantageous to use inflexible piping 510 in locations where movement of the suction plumbing 500 is not desired because inflexible piping 510 may be more durable and less likely to kink than flexible piping 520.

The access lid 213 may open to give access to the inlet 430 through a hole in the step 205 in which the access lid 213 sits. The access lid 213 may include the same materials as the steps 205 or may include different materials. The access lid 213 when closed may be arranged to be stepped on by a user entering or leaving the pool 100.

Figure 3:
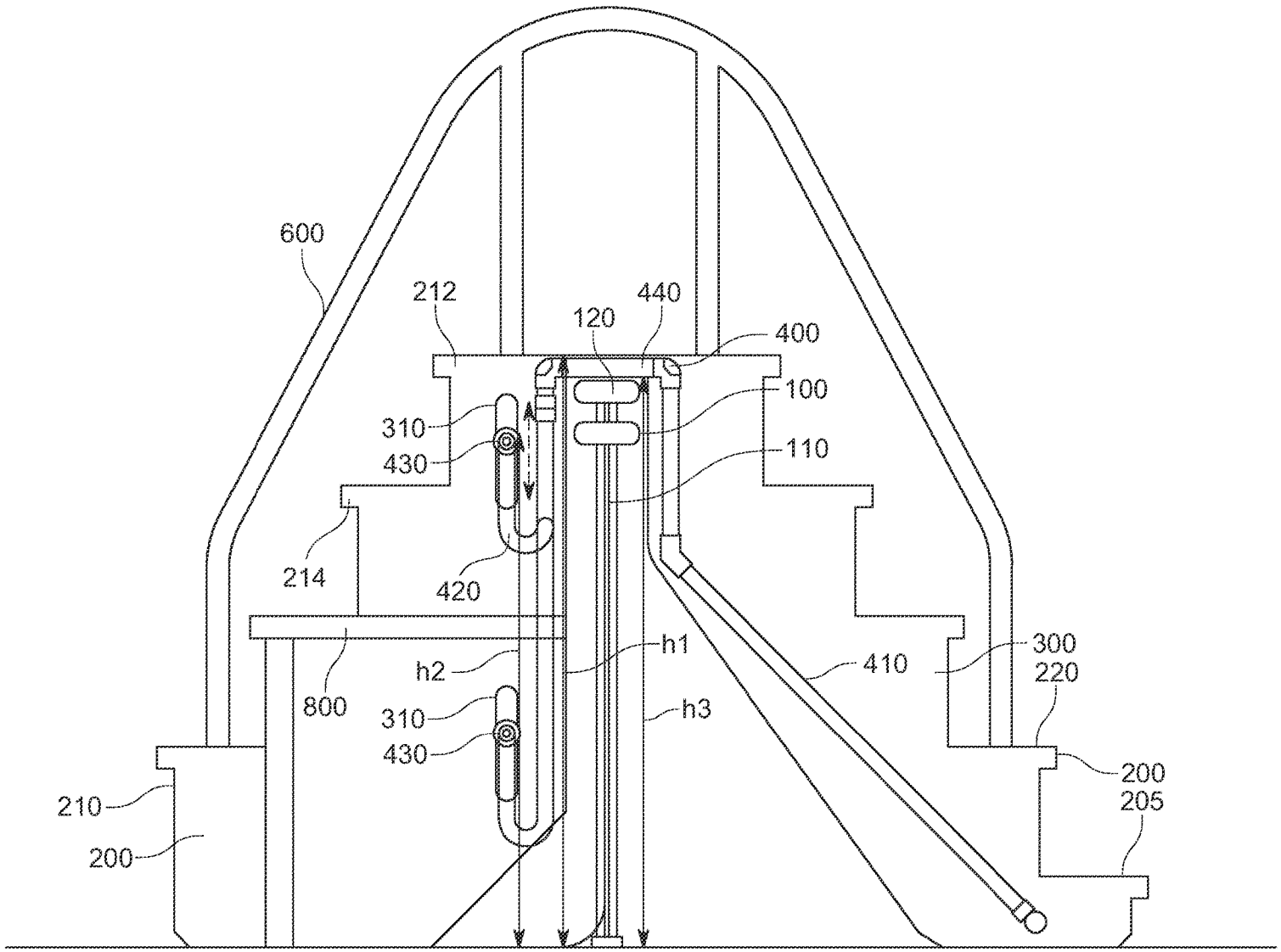
FIG. 3 shows an example first side view of the step structure with the return plumbing and suction plumbing visible through a support structure of the step structure.

FIG. 3 shows an example first side view of the step structure 200 with the return plumbing 400 and suction plumbing 500 visible through a support structure 300 of the step structure 200. The return plumbing 400 and suction plumbing 500 (not shown in this figure) are behind portions of the support structure 300 but are shown through the support structure 300 to show the relative positioning of the components. The step structure 200 may further include the support structure 300 and a bench 800. The bench 800 may extend out beside the steps 205 and be arranged for a user of the pool to be able to sit on the bench 800.

The support structure 300 may include slots 310 for inlets 430 to pass through, connect to, and move in. The inlet 430 may have an adjustable height by moving up and down in the slot 310. The slot 310 may be about 6 inches to 18 inches high. Various mechanisms may be used to secure the inlets 430 in the slots 310, such as friction fit, rails, inlet 430 with variable width, etc. The manner in which the inlet 430 is secured in the slot 310 may allow the inlet 430 to be moved vertically in the slot 310 and also secured in place in the slot 310. The flexible piping 420 may move with the movement of the inlet 430. Thus, the inlet 430 may move without needing to disconnect the inlet 430 from the rest of the return plumbing 400 or adjust the length of the return plumbing 400. A significant amount of extra flexible piping 420 (e.g., more length of pipe than necessary to directly connect the components) may connect the inflexible piping 410 to the inlet 430 in order to prevent kinking in the flexible piping when the inlet 430 is moved. For example, about 12 inches of extra flexible piping 420 may be used.

The return plumbing 400 may be fixed, secured, or coupled to the support structure 300 at points where it passes through the support structure 300 by friction, brackets, nails, screws or other similar devices or structures (these may be examples of second points). The return plumbing 400 may also be fixed, secured, or coupled to the stairs 205, bench 800, or other components of the step structure 200 in various locations to give structure and support to the return plumbing 400.

The steps 205 may include a first flight 210 of steps 205 arranged to rise out of the pool 100 and a second flight 220 of steps 205 arranged to descend out of the pool 100. A highest step 212 may be part of both the first flight of steps 210 and the second flight of steps 220. The first flight 210 of steps 205 may also include a second highest step 214. In some embodiments, consecutive steps 205 may be about 12 inches different in height. The first flight 210 of steps 205 may increase in height in a first direction (from left to right in this image) and the second flight 210 of steps 205 may decrease in height in the first direction.

As shown, the return plumbing 400 may be arranged to go over the rim 120 of the pool 100 (shown in cross section) with a highest point 440 (this may be an example of a second high point) below the highest step 212 and above a second highest step 214. A height h1 of the highest step 212 may be higher than the height h2 of the inlet 430 and a height h3 of the highest point 440 of the return plumbing 400. The height h3 of the highest point 440 may also be higher than the height h2 of the inlet 430. All (e.g., heights h1, 2*h*, and h3) may be measured relative to the ground. The highest point 440 of the return plumbing 400 may be under and aligned with the highest step 212.

Figure 4:
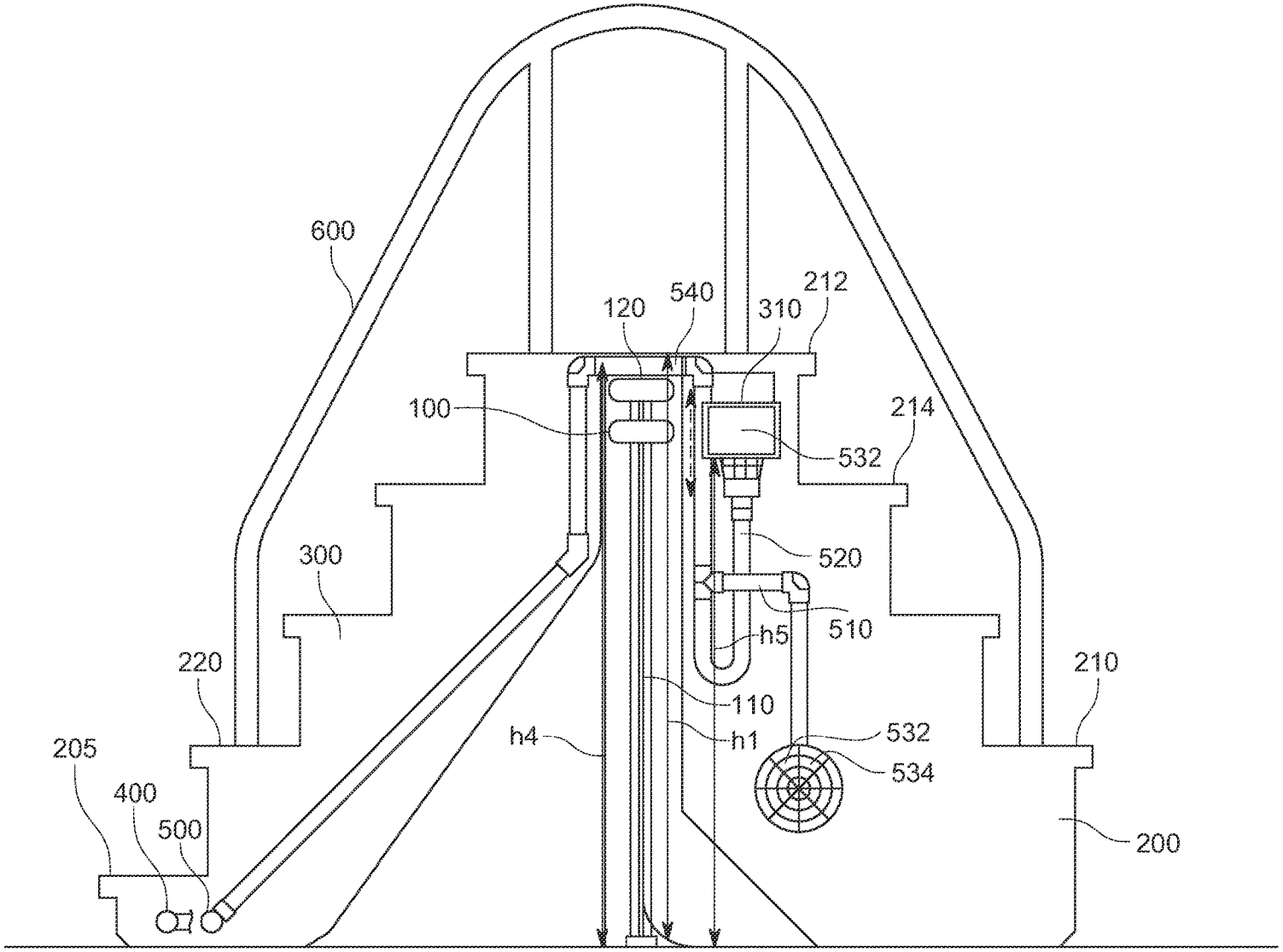
FIG. 4 shows an example second side view of the step structure with the return plumbing and suction plumbing visible through the support structure.

FIG. 4 shows an example second side view of the step structure 200 with the return plumbing 400 and suction plumbing 500 visible through the support structure 300. The return plumbing 400 and suction plumbing 500 are behind portions of the support structure 300 but are shown through the support structure 300 to show the relative positioning of the components. The step structure 200 of FIG. 4 as shown may be an opposite side to the step structure 200 of FIG. 3.

The suction plumbing 500 may pass over the rim 120 of the pool (shown in cross section) at a highest point 540 (this may be an example of a first high point) below the highest step 212 and below the second highest step 214. The height h1 of the highest step 212 may be higher than the height h4 of the highest point 540 of the suction plumbing 400 and the height h5 of the outlet 532. The height h4 of the highest point 540 may also be higher than the height h5 of the outlet 532. Heights h4 and h5 may also be measured relative to the ground. The highest point 540 of the suction plumbing 500 may be under and aligned with the highest step 212.

The suction plumbing 500 may have one or more outlets 532 arranged to be at the water level and be adjustable in height in a slot 310 similarly to how the inlet 430 is arranged to be movable in the slot 310 and also maintain its position in the slot 310. The flexible piping 520 may also function similarly to the flexible piping 420 to allow the outlet 532 to move vertically in the slot 310. A significant amount of extra flexible piping 520 (e.g., more length of pipe than necessary to directly connect the components) may connect the inflexible piping 510 to the outlet 532 in order to prevent kinking in the flexible piping when the outlet 532 is moved. For example, about 12 inches of extra flexible piping 520 may be used.

The outlet 532 at the water level may be a skimmer with a wide opening that may take in floating objects. The outlet 532 at the water level may be accessed via the access lid 213 to clean the outlet 532. The suction of water into the outlet 532 at water level may help circulate water in the pool and cleanout floating debris.

The suction plumbing 500 may also have one or more outlets 534 arranged to be below the water level (this may be an example of a drain or a secondary outlet) and below the outlet 532 arranged to be at the water level. The outlets 534 arranged to be below the water level may include a cover 536 over the outlet 534. The outlet 534 may have negative pressure (i.e. pulling water out of the pool) applied by the water filtration system 700 which may be dangerous to a user if a user is stuck to the outlet 534 while the user's head is underwater. The cover 536 may be arranged and configured to prevent a user from being suctioned to the outlet 534. The cover 536 may include a cage or mesh like structure secured to the support structure 300 around the outlet 534.

The suction plumbing 500 may be arranged to drain water via the outlets 532, 534 and the highest point 540. The return plumbing 400 may be separate from the suction plumbing 500. The return plumbing 400 may be arranged to pump in water to the pool 100 via the highest point 440 and the inlet(s) 430.

Water filtration system 700 and suction plumbing 500 may be arranged to suck water from the pool 100 via the outlets 532, 534. The suction plumbing 500 may split between the water filtration system 700 and the outlets 532, 534. This split makes it so if an object is obstructing one of the outlets 532, 534 the other outlet 532, 534 prevents a seal of the suction plumbing 500 because water can be pulled through the other outlet 532, 534. If the suction plumbing 500 is sealed, it may be dangerous to a person stuck to an outlet 532, 534 and also may be damaging to the water filtration system 700. Different jurisdictions (cities, states, nations, etc.) may have different safety requirements for pools. The outlets 532, 524 and drain cover 536, as well as all other components of the step structure 200, may be arranged or modified to meet these safety requirements.

The suction plumbing 500 may be fixed, secured, or coupled to the support structure 300 at points where it passes through the support structure 300 by friction, brackets, nails, screws or other similar devices or structures (these may be examples of first points). The return plumbing may also be fixed, secured, or coupled to the stairs 205, bench 800, or other components of the step structure 200 in various locations to give structure and support to the suction plumbing 500.

As shown in FIGS. 3 and 4, advantageously, the suction plumbing 500 and the return plumbing 400 may not pass through the bowl 110. This allows the bowl 110 to not include any holes (see FIGS. 1-3) for the suction plumbing 500 and the return plumbing 400 and improves the integrity of the bowl 110 and reduces maintenance costs for the pool 100.

Figure 5:
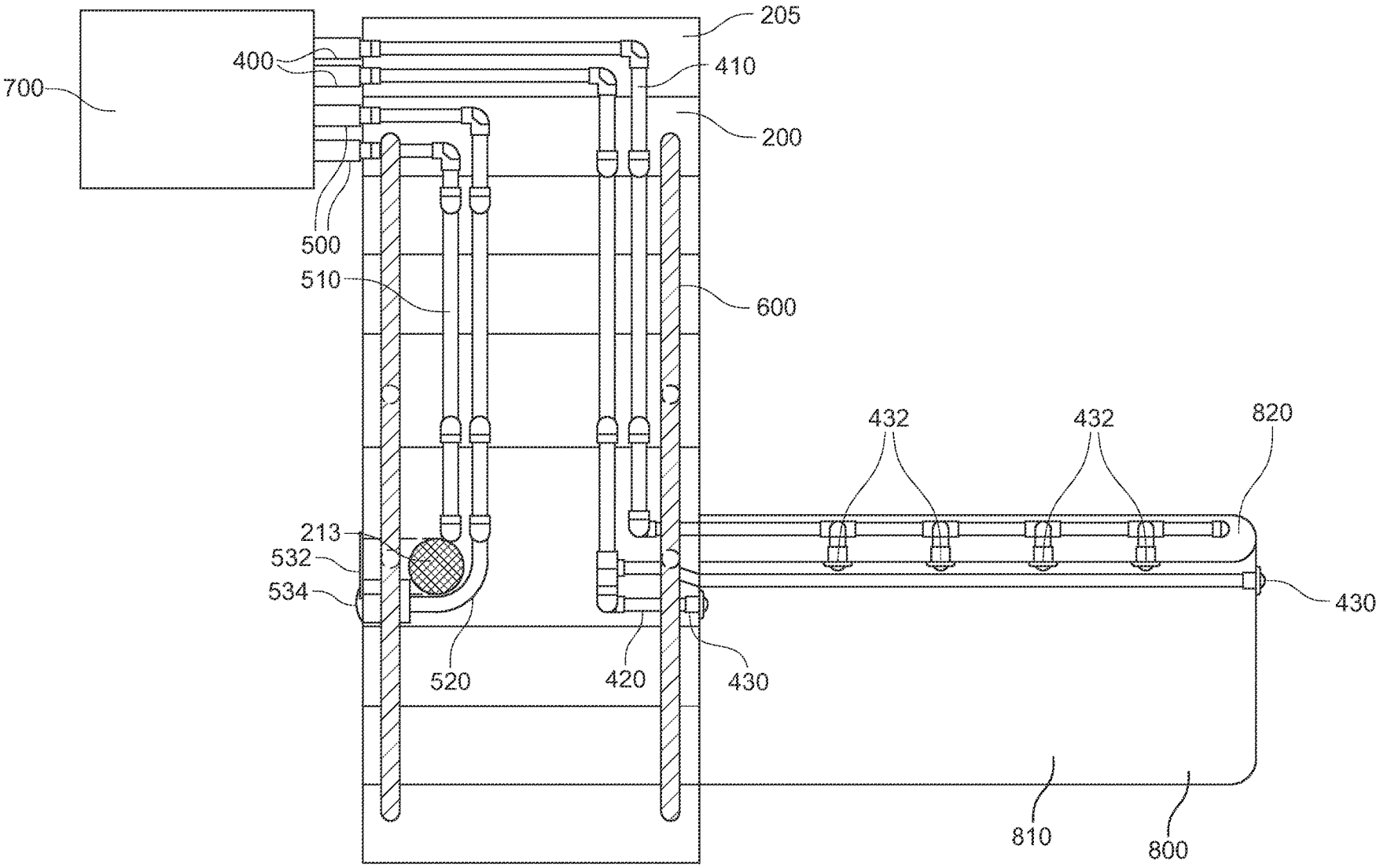
FIG. 5 shows an example top view of the step structure with a bench, where the return plumbing and the suction plumbing are visible through the steps and bench.

FIG. 5 shows an example top view of the step structure 200 with a bench 800, where the return plumbing 400 and the suction plumbing 500 are visible through the steps 205 and bench 800. The step structure 200 may include the bench 800 with a seat 810 and back 820. The bench 800 may be fixed to the rest of the step structure 200 via the side supports or support structure 300 and may extend straight from the stairs 205. This configuration may be paired with a rectangular pool with the back 820 of the pool being against the vertical portion of the bowl 110. The seat may be arranged for a person to sit thereon. The back 820 may be arranged for a person to rest their back thereon. The return plumbing 400 may include bench inlets 432 which pass through the back 820 of the bench 800. The bench inlets 432 may be jets and may be arranged to push water jets on the back of a person sitting on the bench. The return plumbing 400 may pass from under the stairs 205 to under the bench 800. The return plumbing 400 may pass into the back 820 of the bench 800 with the bench outlets 432 passing through a vertical portion of the back 820. The return plumbing 400 may also pass under the seat 810 of the bench 800 and through a portion of the support structure 300 supporting the bench 800 (as shown in FIG. 3). The inlets 430 and bench outlets 432 may help circulate water in the pool 100.

The return plumbing 400 may have separate plumbing paths from the water filtration system 700 to the bench outlets 432 and the inlets 430. The suction plumbing 500 may have separate plumbing paths from the water filtration system 700 to each of the outlets 532, 534.

Figure 6:
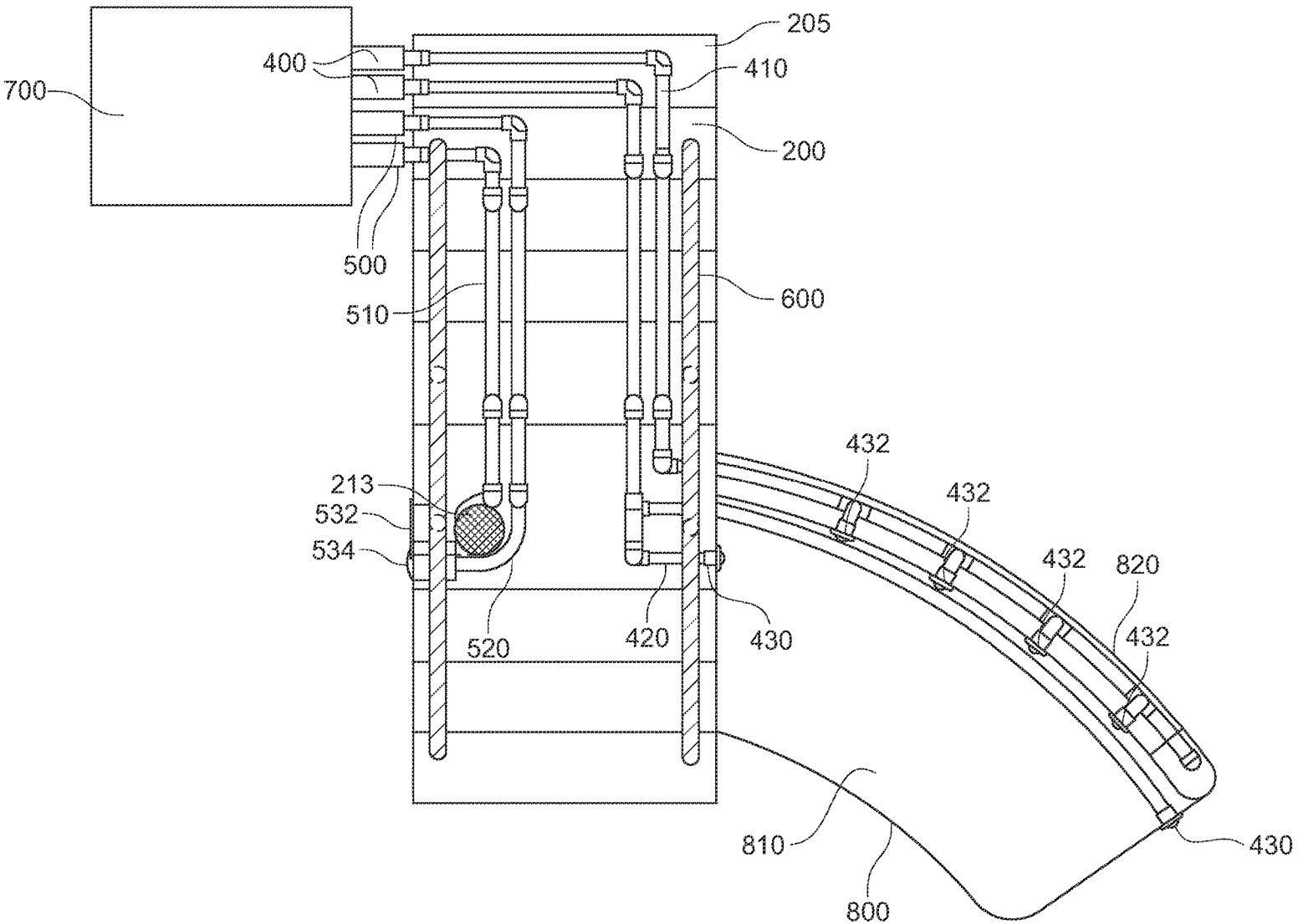
FIG. 6 shows another example top view of the step structure with a bench, where the return plumbing and the suction plumbing are visible through the steps and bench.

FIG. 6 shows another example top view of the step structure with a bench, where the return plumbing and the suction plumbing are visible through the steps 205 and bench 800. The bench 800 may extend from the stairs 205 while curving. This curved bench 800 may be used with pools 100 with an oval or circular shape. The back 820 may contour to the shape of the vertical portion of the bowl 110 of the pool 100 such that the back 820 is against the vertical portion of the bowl 110.

Figure 7:
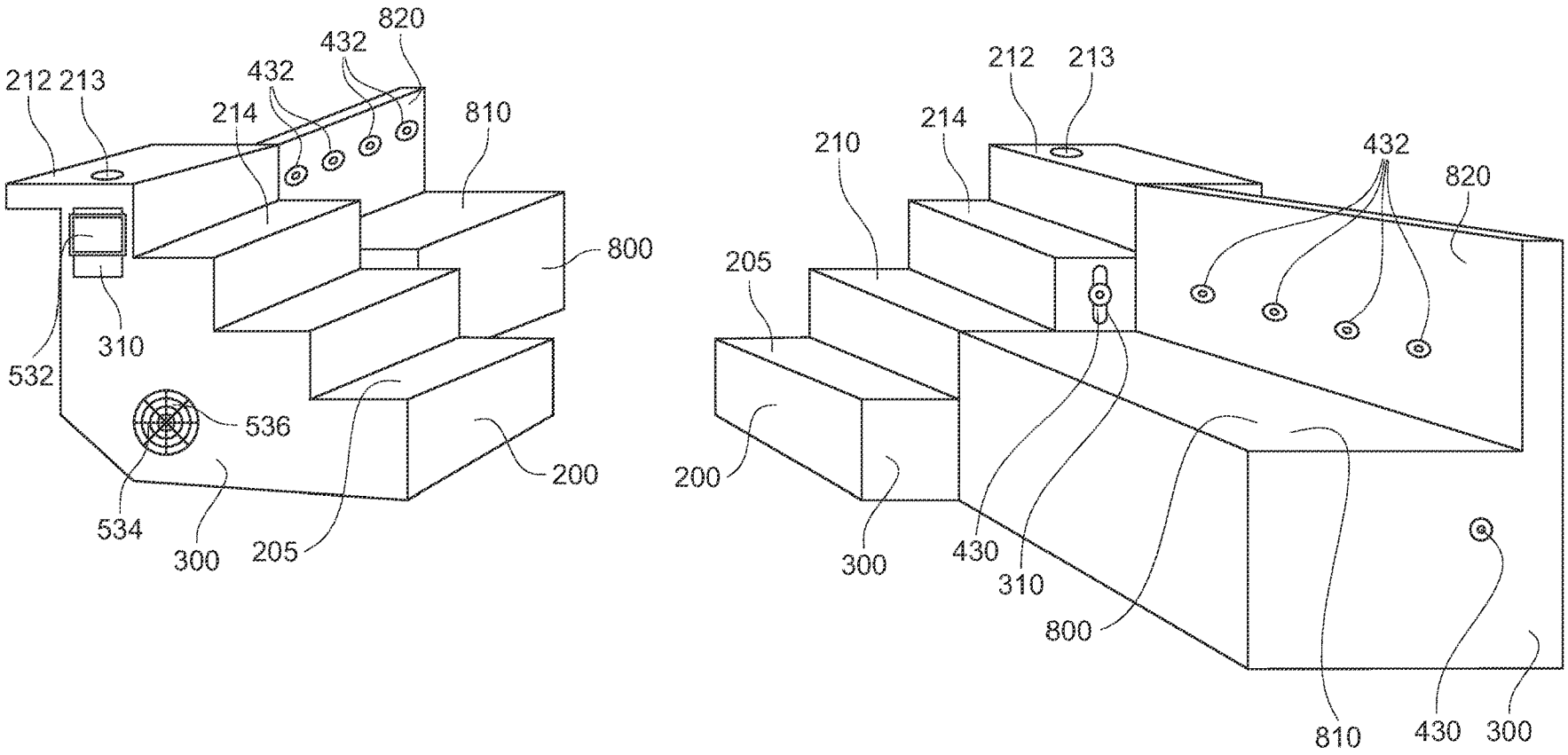
FIG. 7 shows example perspective views of the step structure with a bench.

FIG. 7 shows example perspectives of the step structure 200 with a bench 800. A handrail 600 and second flight 220 are not included in this example embodiment of the step structure 200. This example embodiment may be placed in below ground pools 100 where a second flight 220 is not required. Some of the inlets 430 may be able to move vertically in slits 310 of the support structure 300. Others may be fixed in position. The bench outlets 432 may be through a veritable portion of the back 820 of the bench 800.

The step structure 200 may also be arranged to include water safe electronic devices, such as waterproof speakers, lights, etc. (not shown). The return inlets 430 may be arranged to be above a surface of the water to have a waterfall effect.

Figure 8A:
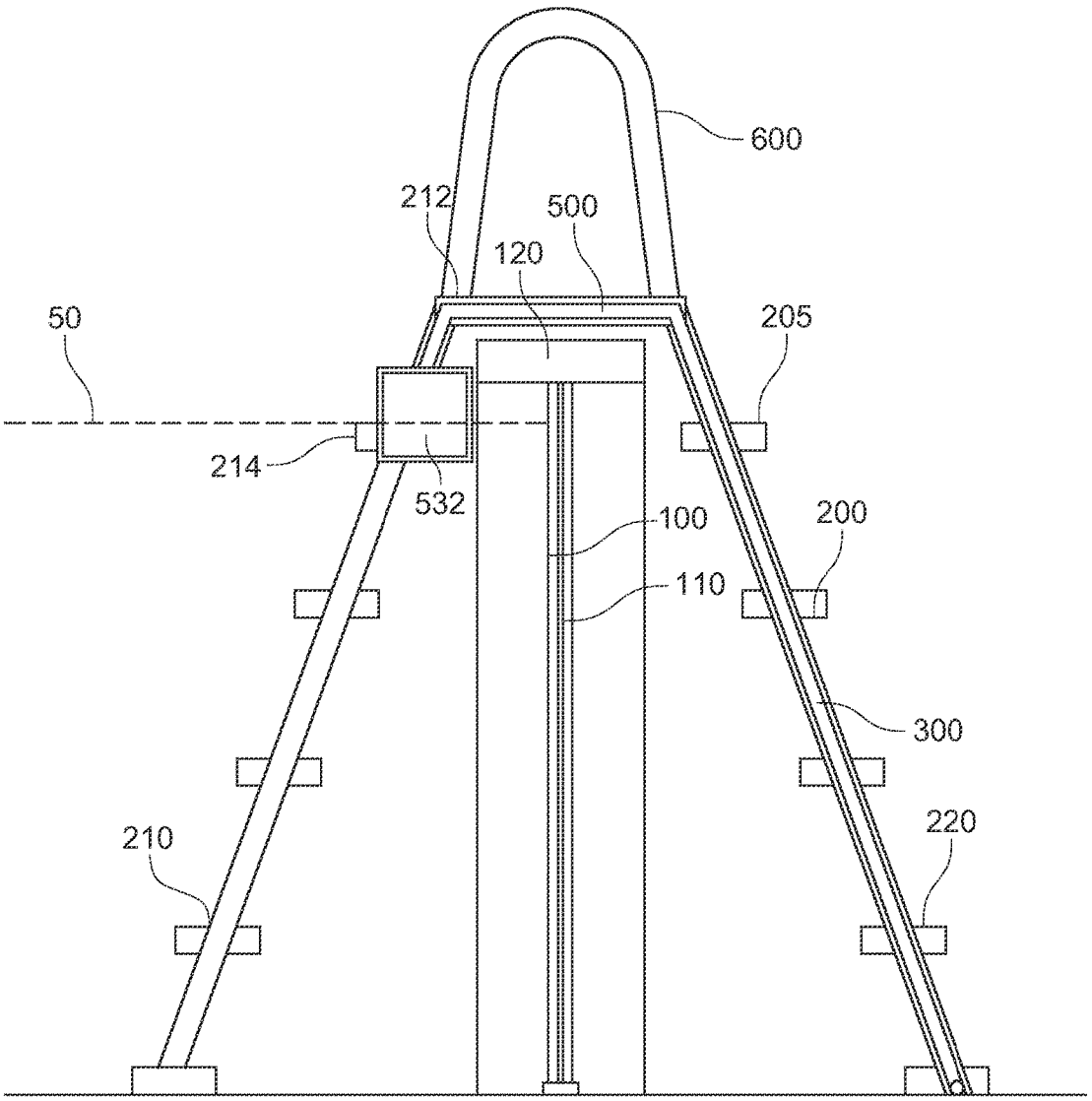
FIGS. 8A and 8B show example views of the step structure passing over the rim of the pool with the suction plumbing and return plumbing visible through the support structure.
Figure 8B:
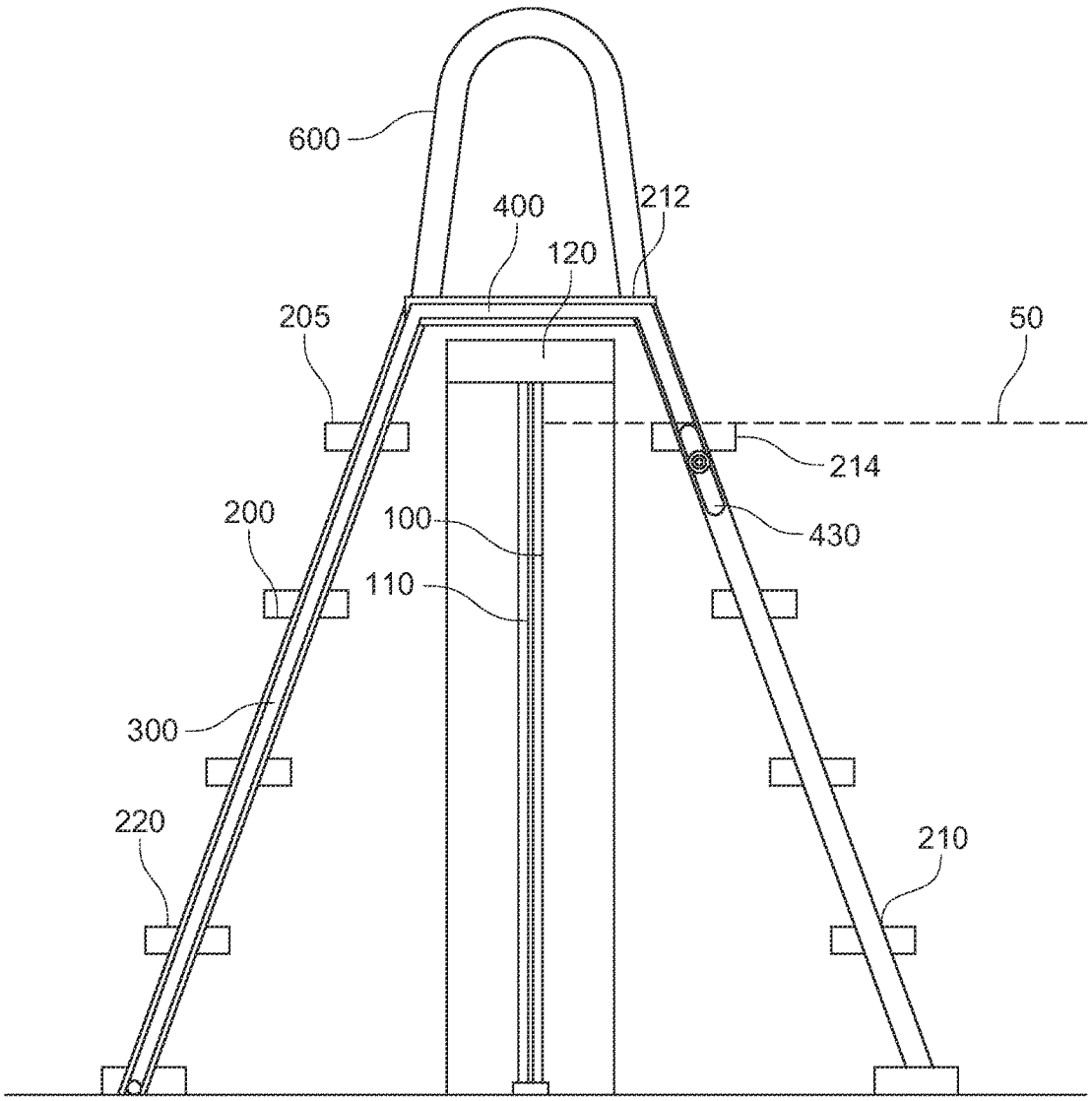

FIGS. 8A and 8B show example side views of the step structure 200 passing over the rim 120 of the pool 100 (shown in cross section) with the suction plumbing 500 and return plumbing 400 visible through the support structure 300. In this example embodiment, the support structure 300 may be in the form of sides of a ladder supporting the first flight 210 and second flight 220; one side of a ladder on each side of the steps 205. The support structure 300 may be a hollow tube with the suction plumbing 500 and return plumbing 400 each passing through one of the hollow tube support structures 300 to the outlet 532 and inlet 430, respectively. It may be advantageous to use flexible plumbing 420 and flexible plumbing 520 in the hollow tubes support structures 300 to assist in manufacturing. However, inflexible plumbing 410 and inflexible plumbing 510 may also be used. The outlet 532 may be able to move vertically on support structure 300 using similar structure as discussed above. The outlet 532 may stick out from the side of the support structure 300 in order to have room for debris to be collected. The inlet 430 (not shown in this figure) on the other ladder side support structure may similarly be able to move vertically using similar structures as discussed above such as slits (not shown in this figure) in the support structure 300. The handrails 600 may extend over only a top step 212. The pool 100 may have a water line 50 (showing the depth of the water in the pool) at the height of the outlet 532. Although the first flight 210 is shown resting on the bottom of the bowl 110, the first flight 210 may also be secured to the side of the bowl 110, the rim 120, or the support structure 300 of the second flight may be secured to the ground (so that the weight of a user stepping on the first flight 210 does not cause the step structure 200 to move significantly). In these cases, the step structure 200 may not touch the bottom of the bowl 110.

Figure 9A:
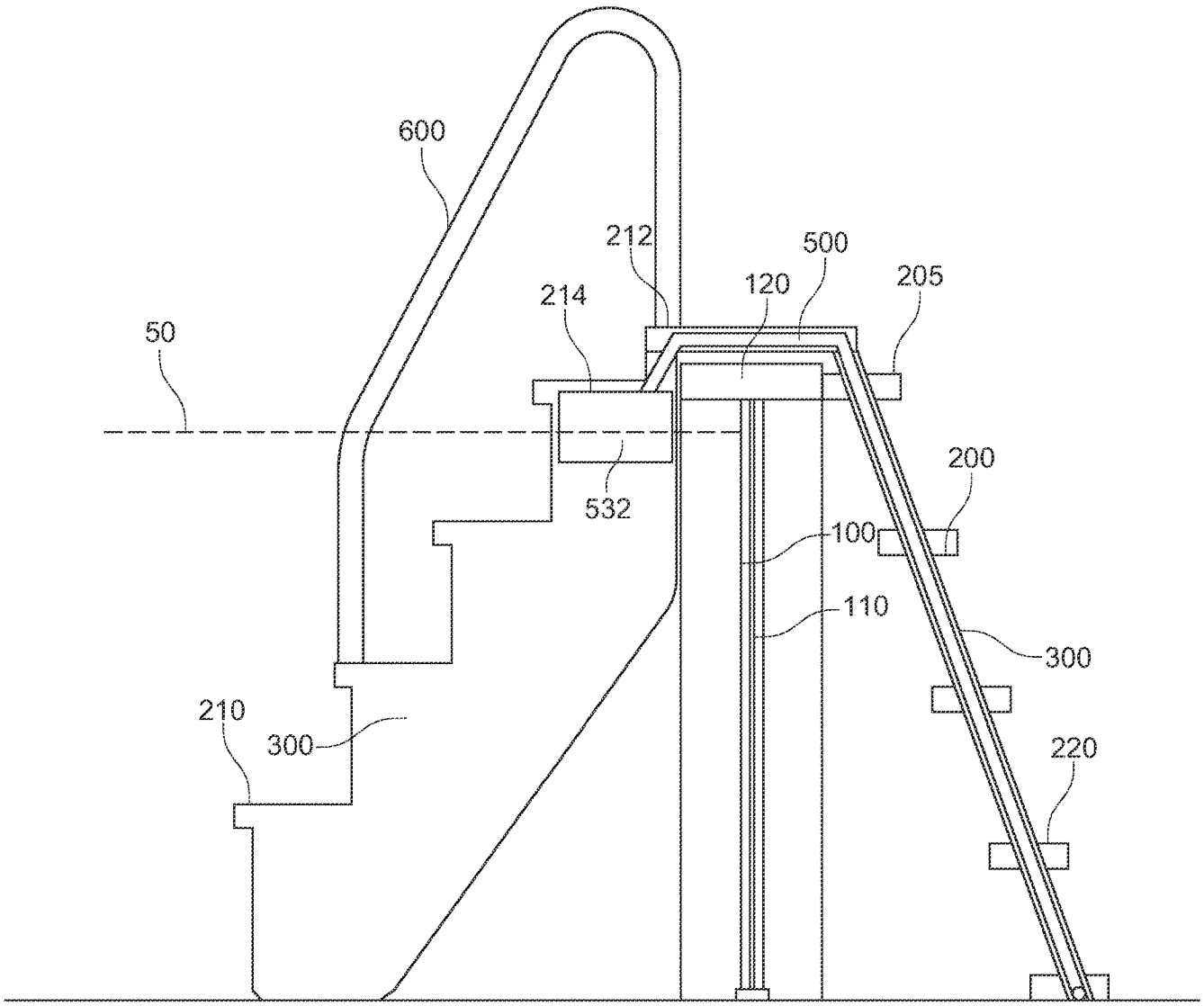
FIGS. 9A and 9B show other example side views of the step structure passing over the rim of the pool with the suction plumbing and return plumbing visible through the support structure.
Figure 9B:
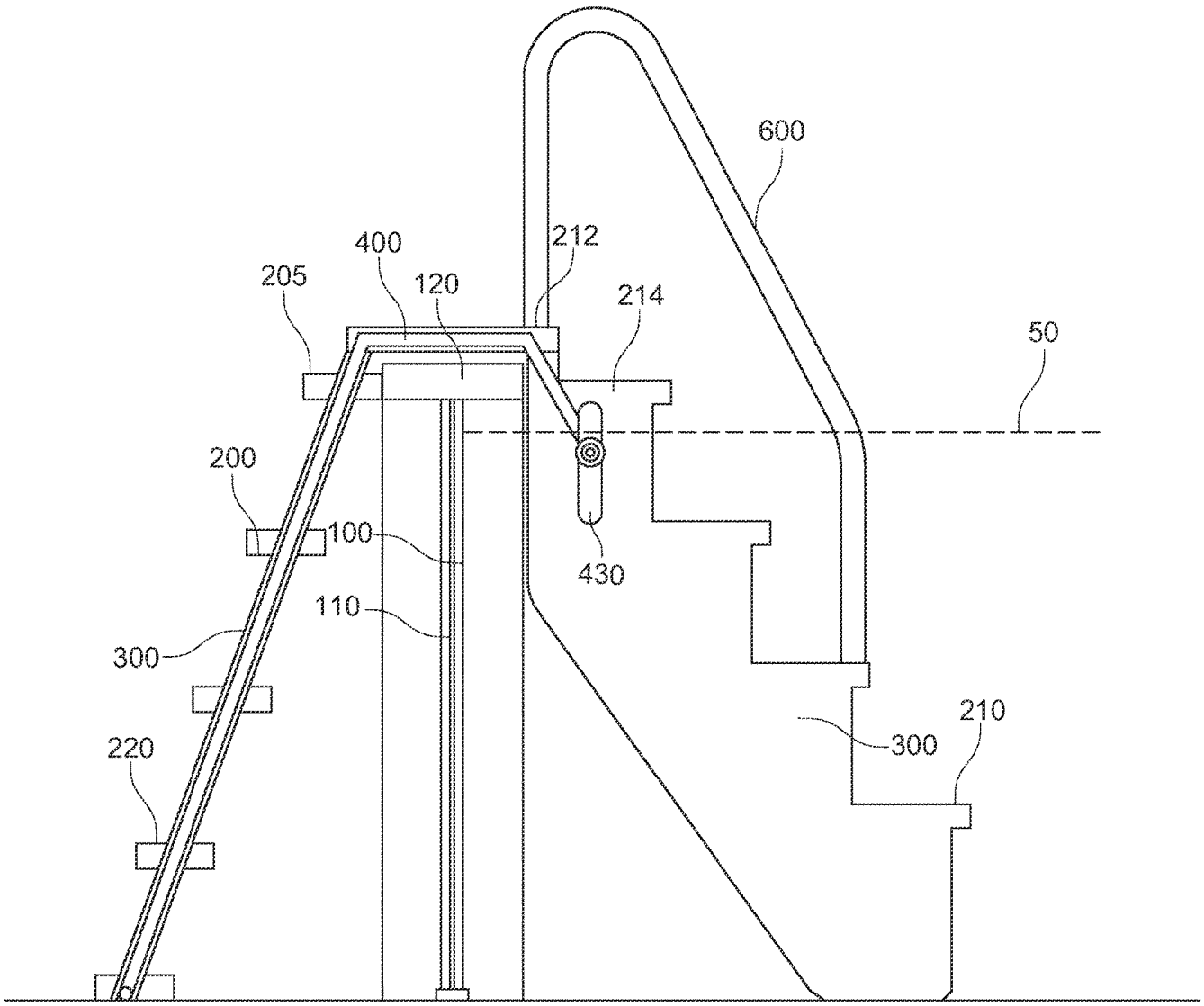

FIGS. 9A and 9B show other example side views of the step structure 200 passing over the rim 120 of the pool 100 (shown in cross section) with the suction plumbing 500 and return plumbing 400 visible through the support structure 300. The support structure 300 for the first flight 210 may include sides of a staircase. The support structure 300 for the second flight 220 may include sides of a ladder. In this way the first flight 210 may be a staircase and the second flight 220 may be a ladder. It is also possible for the first flight 210 to be a ladder (as shown in FIGS. 8A and 8B) and the second flight 220 to be a staircase (as shown in FIG. 3 and FIG. 10).

The suction plumbing 500 and return plumbing 400 may pass through the hollow ladder support structure 300 to under the steps of the first flight 220 and then to the outlet 532 and inlet 430, respectively.

Figure 10A:
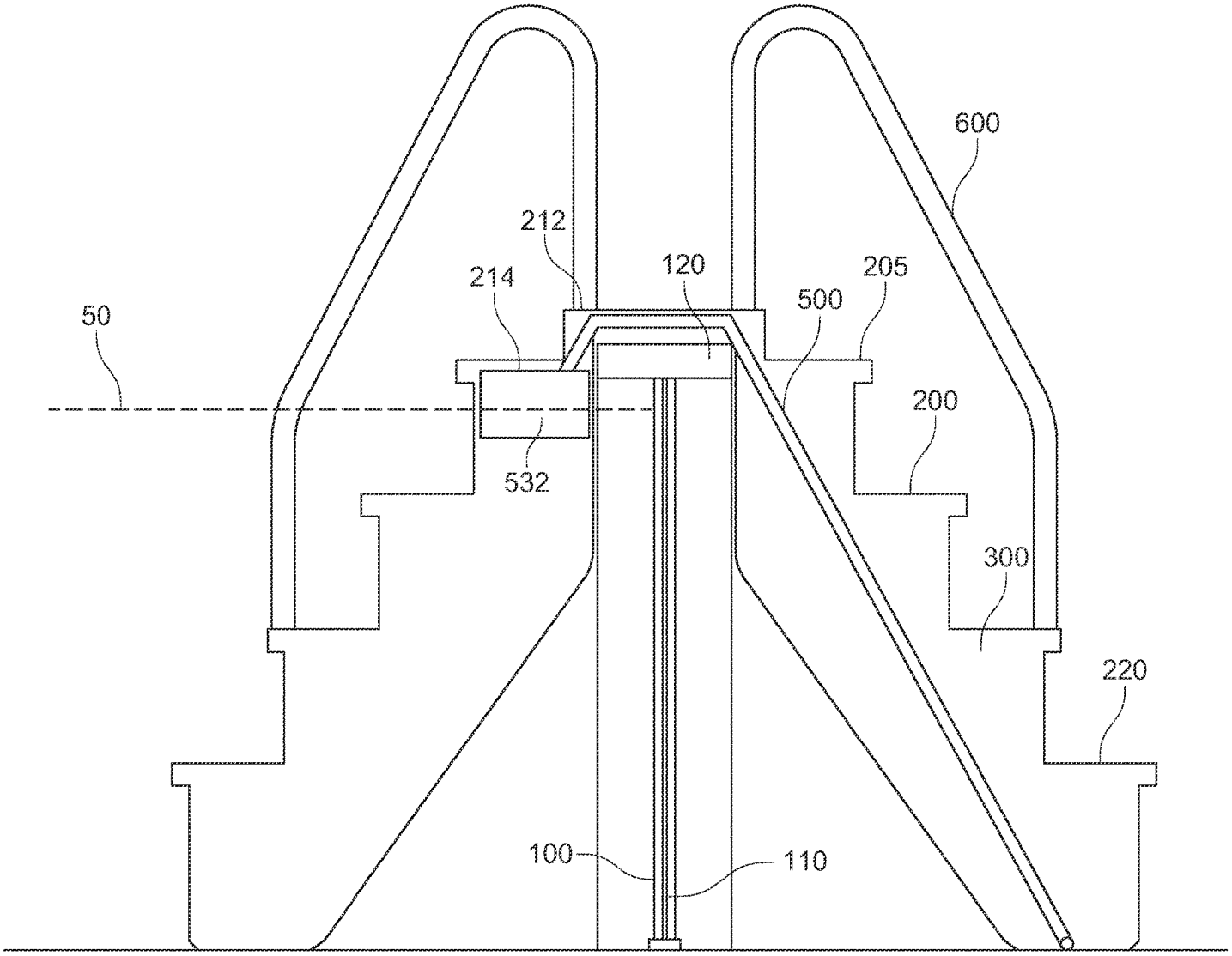
FIGS. 10A and 10B show other example side views of the step structure passing over the rim of the pool with the suction plumbing and return plumbing visible through the support structure.
Figure 10B:
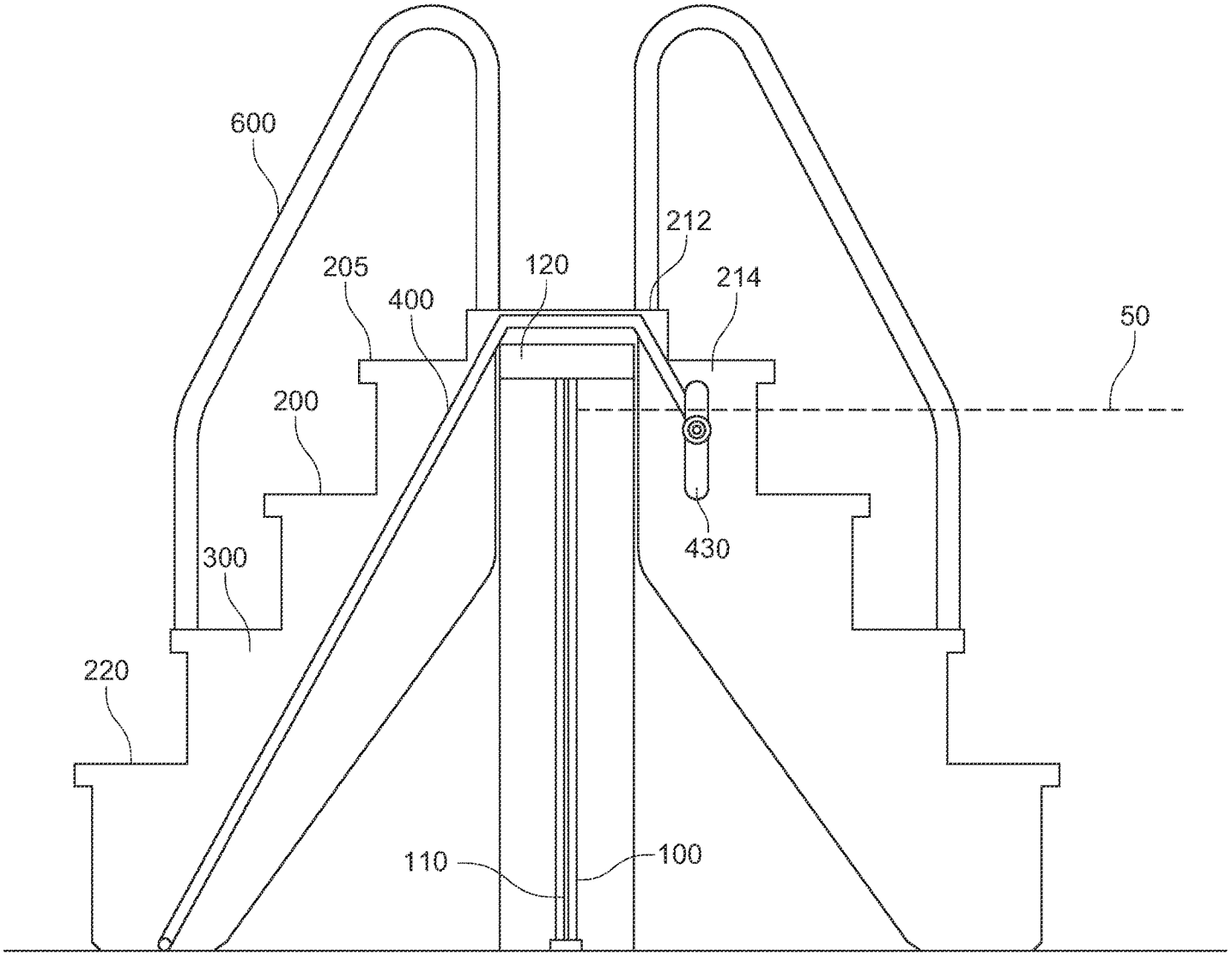

FIGS. 10A and 10B show other example side views of the step structure 200 passing over the rim 120 of the pool 100 (shown in cross section) with the suction plumbing 500 and return plumbing 400 visible through the support structure 300. The support structure 300 for the first flight 210 and the second flight 220 may include supports for a staircase. Thus, the first flight 210 and the second flight 220 may be staircases. Also as shown in FIGS. 10A and 10B and also in FIGS. 3 and 4, the support structure 300 for the staircase may have a variety of shapes. Also, the steps 205 may have varying differences in height between consecutive steps in the flight of steps. For example, the difference in height between the highest step 212 and the second highest step 214 in the first flight 210 may be about 6 inches while the difference in height between the other steps is about 12 inches. Further, in the first flight 210, the distance between a lowest step 205 and the horizontal portion of the bowl 110 may be greater than the distance between the consecutive steps 205. For example, the lowest step 205 in the first flight 210 may be 18 inches above the horizontal portion of the bowl 110. The distances between steps may be regulated and included in safety standards for pools. The distances between steps may be adjusted to meet these safety requirements.

The handrail 600 may be split into two portions, one for each flight of stairs. The characteristics of the handrails 600 may also be regulated by safety standards and the handrail 600 may be adjusted to meet these safety requirements.

The suction plumbing 500 and return plumbing 400 may pass under the highest step 212 and be arranged to pass over the rim 120 of the pool 100. The outlet 532 and inlet 430 may be located below the second highest step 214 of the first flight 210.

Figure 11A:
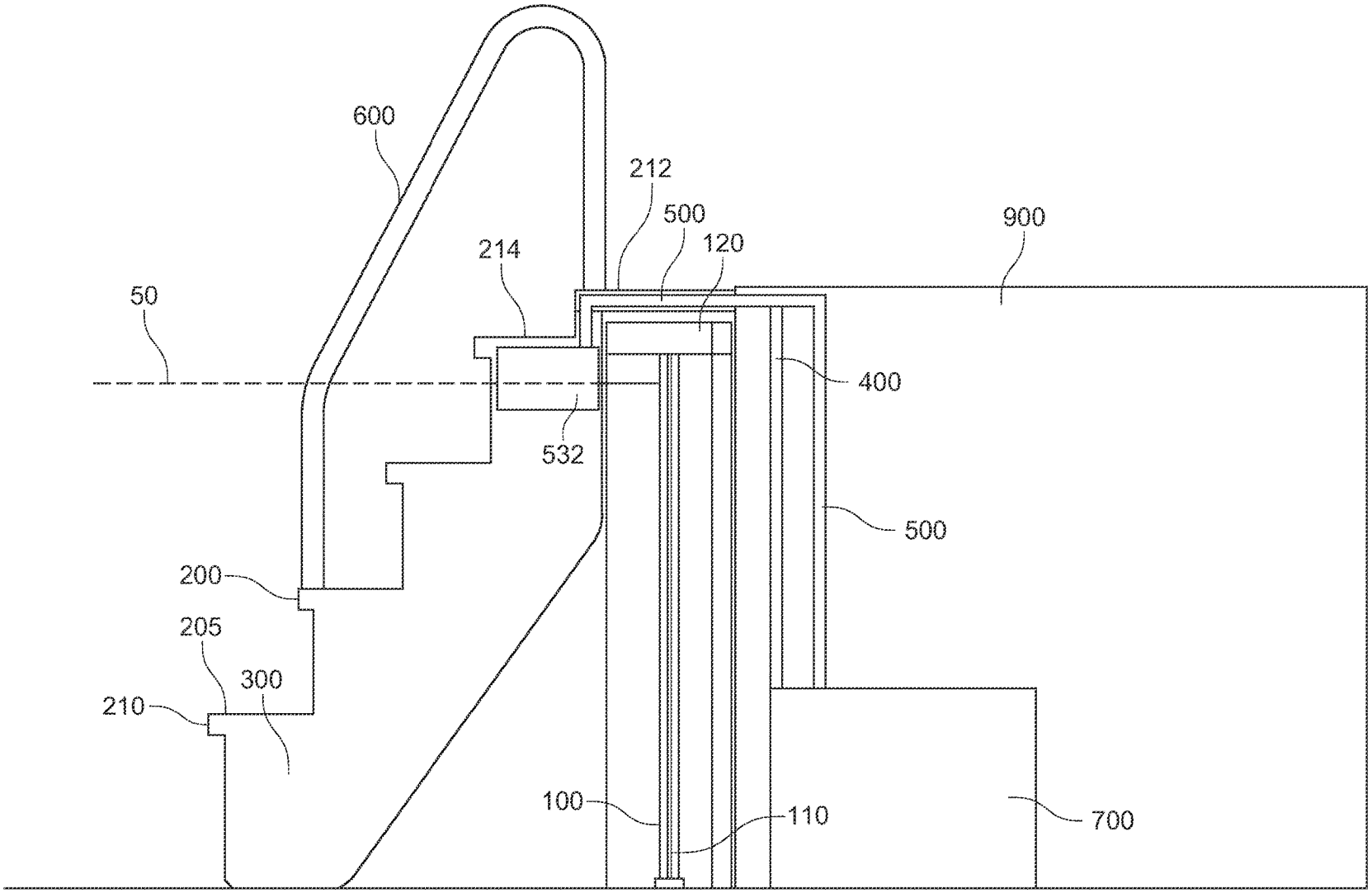
FIGS. 11A and 11B show other example side views of the step structure passing over the rim of the pool with the suction plumbing and return plumbing visible through the support structure.
Figure 11B:
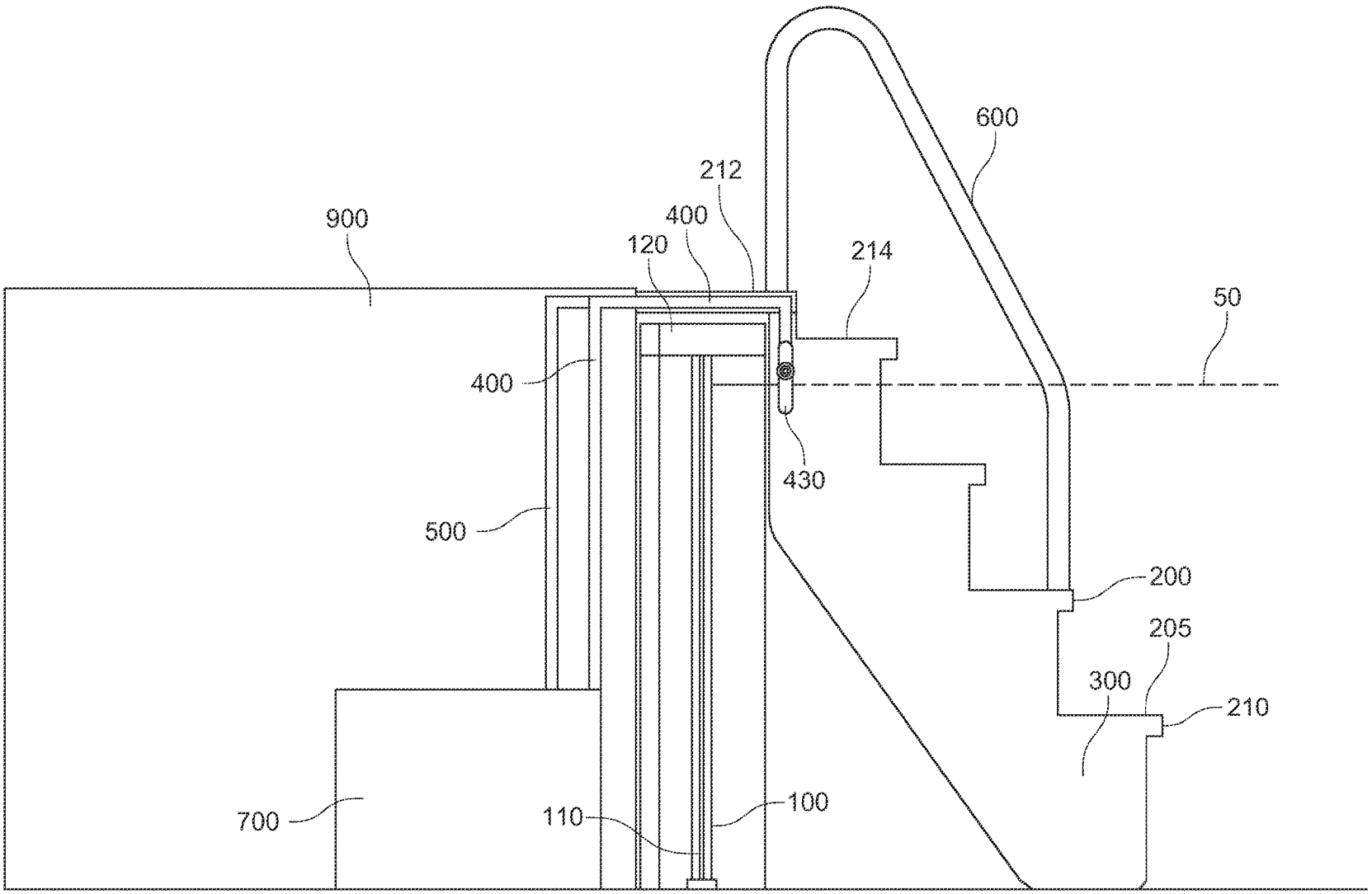

FIGS. 11A and 11B show other example side views of the step structure 200 passing over the rim 120 of the pool 100 (shown in cross section) with the suction plumbing 500 and return plumbing 400 visible through the support structure 300. The step structure 200 may connect to or include a platform 900. The platform 900 may be a deck, raised platform, or ground level platform (if the pool is below ground). The platform 900 may be above the rim 120 of the bowl 110. The platform 900 may be made of any durable material suited for people to walk on, such as wood (preferably sealed to prevent water damage), metal, plastic, or other durable materials. The platform 900 may be arranged to have the water filtration system 700 sit under the platform 900. The return plumbing 400 and suction plumbing 500 may go from the water filtration system 700 over the rim of the pool 120 and under the highest step 212, to the inlet 430 and outlet 532, respectively. The handrail 600 may extend over several of the stairs in the first flight 210. Depending on the configuration of the platform 900, the second flight 220 may be omitted or attached to the platform 900. Although a first flight 210 staircase is shown, the first flight 210 may also be a ladder.

Many different embodiments of the inventive concepts have been shown. A person of ordinary skill in the art will appreciate that the features from different embodiments may be combined or replaced with other features from different embodiments.

Advantageously, the step structures 200 disclosed allow a pool to be constructed without water filtration piping passing through the structure of the bowl 110 of the pool 100, thus, reducing maintenance and upkeep costs for the pool 100. The placement of the inlets 430 and outlets 532 on opposite sides of the step structure 200 allows for good water circulation and removal of floating debris. Various embodiments of the step structure 200 may be used for above ground and below ground pools 100. The inlets 430 and outlets 532 may be adjustable in height for different water levels and circulation effects. The flexible piping 520 and flexible piping 420 allows for the inlets 430 and outlets 532 to be adjusted in height without disconnecting the return plumbing 400 and suction plumbing 500. Many other advantages and benefits are provided by one or more components described herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A device comprising:

a step structure including a plurality of steps and a support structure configured to support the plurality of steps;

a bench fixed to the step structure;

suction plumbing fixed to the step structure, the suction plumbing including a first high point, the suction plumbing including a suction outlet below the first highpoint, the suction plumbing being arranged to drain water via the suction outlet and the first high point; and return plumbing separate from the suction plumbing and fixed to the step structure, the return plumbing including a second high point, the return plumbing including a return inlet, the return plumbing being arranged to output water via the second high point and the return inlet.

2. The device of claim 1, wherein the plurality of steps includes a first flight of steps and a second flight of steps.

3. The device of claim 2, wherein the first flight of steps increases in height in a first direction and the second flight of steps decreases in height in the first direction.

4. The device of claim 1, wherein the step structure includes a staircase.

5. The device of claim 1, wherein the step structure includes a ladder.

6. The device of claim 1, wherein the step structure includes a staircase and a ladder.

7. The device of claim 1, wherein the step structure further includes a handrail.

8. The device of claim 1, wherein the plurality of steps includes a first flight of steps, the first flight of steps including a highest step having a first height higher than heights of other steps of the plurality of steps in the first flight of steps, the first flight of steps including a second highest step with a second height less than the first height, wherein the first high point of the suction plumbing and the second high point of the return plumbing are under and aligned with the highest step at the first height above the second height.

9. The device of claim 1, wherein the suction plumbing includes a secondary outlet below the suction outlet.

10. The device of claim 1, wherein the suction outlet is adjustable in height, and the return inlet is adjustable in height.

11. The device of claim 1, wherein the suction plumbing includes flexible tubing, and the return plumbing includes flexible tubing.

12. The device of claim 1, wherein the suction plumbing is fixed to the step structure at a plurality of first points and the return plumbing is fixed to the step structure at a plurality of second points.

13. The device of claim 1 wherein the bench extends out beside the step structure.

14. The device of claim 13, wherein the return inlet is fixed to the bench.

15. A device comprising:

a pool including a bowl with a rim, the bowl defining an area arranged to be filled with water, the rim being the highest point of the bowl of the pool around an exterior of the bowl;

a step structure including a plurality of steps and a support structure configured to support the plurality of steps, the step structure extending over a portion of the rim of the pool;

a bench fixed to the step structure;

suction plumbing fixed to the step structure, the suction plumbing including a suction outlet below the rim of the bowl, the suction plumbing being arranged to drain water via the suction outlet; and return plumbing separate from the suction plumbing and fixed to the step structure, the return plumbing including a return inlet, the return plumbing being arranged to output water via the return inlet.

16. The device of claim 15, wherein the suction plumbing and the return plumbing do not pass through the bowl.

17. The device of claim 15, wherein the bench extends out beside the step structure.

18. The device of claim 15, further comprising a water filtration system, wherein the suction plumbing is connected as an input to the water filtration system and the return plumbing is connected as an output to the water filtration system.

19. The device of claim 15, wherein the step structure is fixed to a platform above the rim of the bowl.

20. The device of claim 15, wherein the suction plumbing includes a secondary suction outlet below the suction outlet.

* * * * *